US005604524A

United States Patent [19]

Itoh et al.

[11] Patent Number: 5,604,524

[45] Date of Patent: Feb. 18, 1997

[54] ELECTROSTATIC IMAGE FORMING APPARATUS

[75] Inventors: Yoshimasa Itoh, Machida; Shinichi Takano; Tetsuya Kato, both of Kawasaki; Sohji Tsuchiya, Kanagawa-ken; Yasue Matsuya, Sagamihara, all of Japan

[73] Assignee: Matsushita Electric Industrial Co., Ltd., Japan

[21] Appl. No.: 116,952

[22] Filed: Sep. 7, 1993

[30] Foreign Application Priority Data

Sep. 9, 1992 [JP] Japan ..... 4-240522
Jul. 28, 1993 [JP] Japan ..... 5-186043

[51] Int. Cl.[6] ..... G03G 15/16; G03G 5/06

[52] U.S. Cl. ..... 347/112

[58] Field of Search ..... 347/112

[56] References Cited

FOREIGN PATENT DOCUMENTS 1-38765 2/1989 Japan .
1-274186 11/1989 Japan .

*Primary Examiner*—Huan H. Tran
*Attorney, Agent, or Firm*—Rossi & Associates

[57] ABSTRACT

An electrostatic image forming apparatus 1 comprises a sensitized drum 2 covered with a single, organic, photosensitive layer (OPC). This sensitized drum 2 is rotatable at a predetermined speed. A charging device 5 is disposed around the drum 2 for uniformly charging a surface of the OPC. A latent image forming device 6 is disposed downstream of the charging device 5 around the drum 2 for forming a latent image on the OPC. A developed image forming device 7 is disposed downstream of the latent image forming device 6 around the drum 2 for forming a developed image from the latent image. A distance from the charging device 5 to the latent image forming device 6 is defined with respect to a distance from the charging device 5 to the developed image forming device 7 by the following expression;

$$T1 \leqq T2 - 0.5 \log T2 - 0.48$$

wherein T1 is a time required for the drum 2 to rotate from the charging device 5 to the latent image forming device 6, and T2 is a time required for the drum 2 to rotate from the charging device 5 to the developed image forming device 7.

16 Claims, 11 Drawing Sheets

ELECTROSTATIC IMAGE FORMING APPARATUS

BACKGROUND OF THE INVENTION

1. Field of the Invention

The present invention relates generally to an electrostatic image forming apparatus, and more particularly to an electrophotographic, electrostatic image forming apparatus using a single, organic, photosensitive layer.

2. Description of the Prior Art

There has been conventionally known chiefly two types of electrophotographic sensitized materials. One type is an inorganic photoconductive material such as amorphous selenium and amorphous silicon, and the other type is an organic photoconductive material.

In case of amorphous selenium, there are problems of thermal stability and stress sensitivity due to its phase change. Furthermore, its spectral sensitivity is limited within a visible-ray region. Therefore, it cannot be directly used for a laser printer which normally uses a laser beam having a wave length of an infrared-ray region. In order to solve this problem, there was an attempt to add arsenic or tellurium. This attempt, however, will not be preferable in view of environmental safety.

In case of amorphous silicon, there are problems in charge characteristics and productivity, although it has high sensitivity and excellent printing durability.

On the other hand, the organic photoconductive material (abbreviated as OPC hereinafter) has several advantages compared with the inorganic photoconductive material. For example, the OPC is inherently safe and economical. A recent enthusiastic improvement of the OPC has realized a sensitivity as good as the inorganic photoconductive material. Thus, the OPC is now becoming a main electrophotographic material.

The OPC is generally constituted by a charge generating layer (abbreviated as a CG layer, hereinafter) and a charge transferring layer (abbreviated as a CT layer, hereinafter). The CG layer absorbs a light and generates a carrier, and the CT layer transfers the generated carrier. Namely, a conventional OPC is characterized by a negative charging method. The negative charge type OPC is, however, disadvantageous in that; photosensitive characteristics is deteriorated by ozone generated from the negative charging device; uniform discharge condition is not obtained; and its manufacturing is adversely affected by a surface of a conductive substrate.

In order to solve such disadvantages, a development of a positive charge type OPC has earnestly being carried out. Up to now, chiefly two positive charge type OPCs are developed. First one is a reversed double-layer type OPC which has a reversed construction in the layout of the CG layer and the CT layer when compared with the above-described negative charge type OPC. Second one is a single-layer type OPC which includes various CG agent and CT agent dispersed in a high polymer binder.

In the reversed double-layer type OPC, the CG layer is placed at an outermost side of the sensitive layer and therefore needs to bear under repetitive printing operations, although the CG layer is inherently required to reduce its thickness. Accordingly, the reversed double-layer type OPC has disadvantages in its printing durability and life time. Furthermore, the double-layer construction will complicate the manufacturing steps. A peeling phenomenon may also occur between two, CG and CT, layers.

On the contrary, the single-layer type OPC is generally inferior to the double-layer type OPC in sensitivity, charging characteristics, and residual charge voltage stability. However, the single-layer type OPC has excellent printing durability because of uniformly dispersed photosensitive material which is relatively thick and therefore strong against the wear. Moreover, it is apparent that the manufacturing steps are simple.

Hence, the inventors of this application have diligently studied the single-layer type OPC which includes nonmetallic phthalocyanine and high polymer, and have developed a photosensitive material including X-type phthalocyanine and manufacturing method of the same as shown in Unexamined Japanese Patent Application No. 3-287171/1991.

One major problem to be solved to realize an electrophotographic apparatus using the single-layer type OPC is a worse response due to induction time which is peculiar to the single-layer type OPC.

Furthermore, the size reduction of a sensitized drum in an electrophotographic apparatus is very important for lowering both manufacturing cost and operation cost.

SUMMARY OF THE INVENTION

Accordingly, an object of the present invention is to provide an electrostatic image forming apparatus capable of making best use of the advantages of the single-layer type OPC.

In order to accomplish above purpose, a first aspect of the present invention provides an electrostatic image forming apparatus comprising:

a sensitized drum covered with a single, organic, photosensitive layer, the sensitized drum being rotatable at a predetermined speed;

charge means, disposed around the sensitized drum, for uniformly charging a surface of the photosensitive layer of the sensitized drum;

latent image forming means, disposed downstream of the charge means around the sensitized drum, for forming a latent image on the photosensitive layer; and developed image forming means, disposed downstream of the latent image forming means around the sensitized drum, for forming a developed image from the latent image.

A distance from the charge means to the latent image forming means is defined with respect to a distance from the charge means to the developed image forming means by the following expression, $$T1 \leqq T2 - 0.5 \log T2 - 0.48$$

wherein T1 is a time required for the sensitized drum to rotate from the charge means to the latent image forming means, and T2 is a time required for the sensitized drum to rotate from the charge means to the developed image forming means.

Or, the distance from the charge means to the developed image forming means is defined by the following expression, $$T2 \geqq 0.11 \text{ sec}$$

wherein T2 is a time required for the sensitized drum to rotate from the charge means to the developed image forming means.

A second aspect of the present invention provides an electrostatic image forming apparatus comprising:

a sensitized drum covered with a single, organic, photosensitive layer, the sensitized drum being rotatable at a predetermined speed;

charge means, disposed around the sensitized drum, for uniformly charging a surface of the photosensitive layer of the sensitized drum;

latent image forming means, disposed downstream of the charge means around the sensitized drum, for forming a latent image on the photosensitive layer; and electric charge removal means, disposed upstream of the charge means around the sensitized drum, for removing electric charge from the surface of the photosensitive layer by irradiating light so as to erase the latent image.

A distance from the electric charge removal means to the charge means is defined by the following expression, $$T3 \leqq 0.2\ sec$$

wherein T3 is a time required for the sensitized drum to rotate from the electric charge removal means to the charge means.

Or, the light of the electric charge removal means has a wave length of 550 nm to 800 nm.

Furthermore, a third aspect of the present invention provided an electrostatic image forming apparatus comprising:

a sensitized drum covered with a single, organic, photosensitive layer, the sensitized drum being rotatable at a predetermined speed;

charge means, disposed around the sensitized drum, for uniformly charging a surface of the photosensitive layer of the sensitized drum;

exposure means, disposed downstream of the charge means around the sensitized drum, for forming a latent image on the photosensitive layer;

developed image forming means, disposed downstream of the latent image forming means around the sensitized drum, for forming a developed image from the latent image; and the exposure, means having a light intensity equal to or more than 10 $\mu W/cm^2$ and having an exposure time equal to or less than 10 ms.

It is preferable that the photosensitive layer has a specified exposure time Tn which accounts for 65% or less of a response time $T_{1/2}$, wherein the response time $T_{1/2}$ is defined as a half-value time required for electric charge voltage on the sensitized drum to decrease to a half value, and the specified exposure time Tn is defined as a minimum exposure time required for the exposure means to obtain a constant response time $T_{1/2}$.

Furthermore, it will be preferable that a product of the light intensity of the exposure means and the specified exposure time Tn is within a range of $3\times10^{-5}$ to $1\times10^{-7}$ $sec\cdot W/cm^2$.

Still further, a fourth aspect of the present invention provides an electrostatic image forming apparatus comprising:

a single, organic, photosensitive layer of nonmetallic phthalocyanine, which is positively charged;

spot exposure means for forming a latent image on the photosensitive layer; and the spot exposure means having a minimum light intensity Imin whose value is in a range of 0.1 to 2 mW on the photosensitive layer.

The minimum light intensity Imin is substantially defined by the following expression:

$$Imin=E_{1/10}/(T\times N)$$

wherein, $E_{1/10}$ represents an exposure energy required to reduce a surface voltage of the photosensitive layer to 1/10 value, T represents an exposure time, and N is a dividing number for gradation.

Or, the spot exposure means has a light intensity in a range of 0.1 to 4 mW on the photosensitive layer, and has a minimum exposure time Tmin equal to or more than $10\times10^{-9}$. And the minimum exposure time Tmin is substantially defined by the following expression:

$$Tmin=E_{1/10}/(I\times N)$$

wherein, I represents an exposure light intensity.

Otherwise, the spot exposure means has a minimum light intensity Imin whose value is equal to or more than 0.1 mW on the photosensitive layer, and has a minimum exposure time Tmin equal to or more than $10\times10^{-9}$. And the minimum light intensity Imin and the minimum exposure time Tmin are substantially defined by the following expression:

$$Imin=E_{1/10}/(T\times N)$$

$$Tmin=E_{1/10}/(I\times N)$$

The above and other objects, features and advantages of the present invention will become more apparent from the following detailed description which is to be read in conjunction with the accompanying drawings.

DETAILED DESCRIPTION OF THE PREFERRED EMBODIMENTS

Hereinafter, with reference to accompanying drawings, preferred embodiments of the present invention will be explained in detail.

FIRST EMBODIMENT

Figure 1:
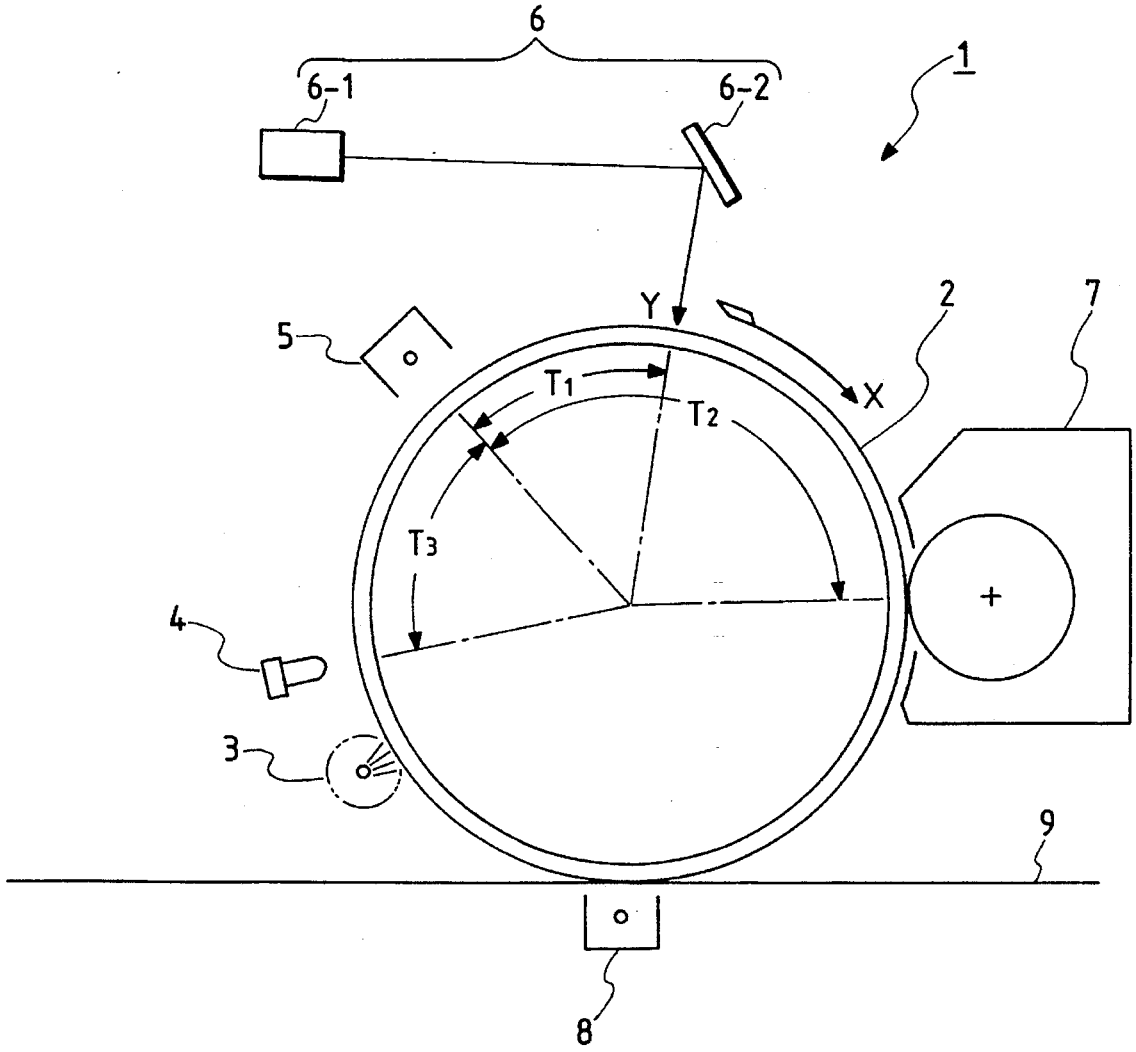
FIG. 1 is a schematic view showing an electrostatic image forming apparats embodying the present invention.

FIG. 1 shows an electrostatic image forming apparats embodying the present invention. FIG. 1 is a view schematically showing an electrostatic image forming apparatus 1 which is conventionally well known as a laser printer. FIG. 1 shows only the essential components and therefore a casing and other components thereof are omitted.

In FIG. 1, a reference numeral 2 represents a cylindrical sensitized drum which is driven by a motor (not shown) so as to rotate at a predetermined speed in a clockwise direction as shown by an arrow X. There are provided a tonor cleaner 3, a charge removal lamp 4, a charge unit 5, an exposure optics 6, a develop unit 7, and a transfer unit 8, respectively disposed around the sensitized drum 1 in the clockwise direction.

The tonor cleaner 3 scrapes a toner off the sensitized drum 2. The charge removal lamp 4 irradiates a light on all the surface of the sensitized drum 2 to completely remove electric charges therefrom. The surface of the sensitized drum 2 is thus initialized and then conveyed to the charge unit 5 disposed downstream of the charge removal lamp 4. The charge unit 5 uniformly charges the surface of the sensitized drum 2 so as to have a predetermined surface voltage. A positional relationship between the charge removal lamp 4 and the charge unit 5 is defined by T3 in terms of time difference. This time difference T3 is a value required for the sensitized drum 2 to rotate from the charge removal lamp 4 to the charge unit 5.

The exposure optics 6 is disposed downstream of the charge unit 5. The exposure optics 6 includes a semiconductor laser 6-1 for emitting a laser beam and a mirror 6-2 for converging the laser beam onto the surface of the sensitized drum 2. This exposure optics 6 is operative to form areas of latent image on the surface of the sensitized drum 2 by locally irradiating laser beam in accordance with information to be printed. A positional relationship between the charge unit 5 and the laser irradiating point Y of the exposure optics 6 is defined by a time difference T1, which is equal to a value required for the sensitized drum 2 to rotate from the charge unit 5 to the laser irradiating point Y.

The develop unit 7 is disposed downstream of the laser irradiating point Y. The develop unit 7 forms a developed image by attracting a toner onto the latent image. A positional relationship between the laser irradiating point Y and the develop unit 7 is defined by a time difference T2, which is equal to a value required for the sensitized drum 2 to rotate from the laser irradiating point Y to the develop unit 7.

The transfer unit 8, disposed downstream of the develop unit 7, transfers the toner image onto a paper 9 or fuses it there by heat.

In this manner, the toner cleaner 3, the charge removal lamp 4, the charge unit 5, the exposure optics 6, the develop unit 7, and the transfer unit 8 are cooperative to constitute a so-called electrophotographic cycle.

The inventors of this application have tried various tests on the positive charging, single-layer type OPC. As a result of these researches, they finally found the way of optimizing positional various relationship of electrophotographic cycle components and specifying details of the exposure light source.

Figure 2:
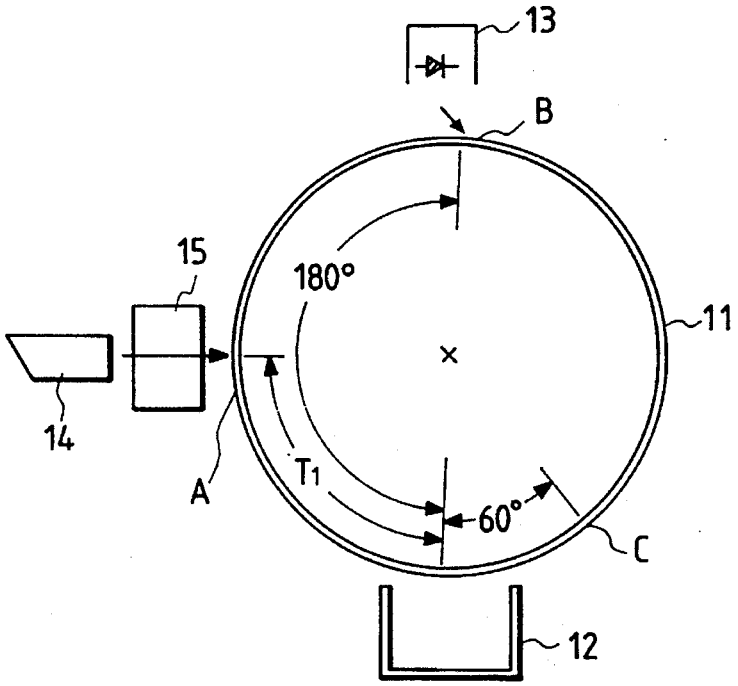
FIG. 2 is a view schematically showing a testing apparatus used in accordance with the first embodiment of the present invention.

FIG. 2 is a view showing a testing apparatus used. In the drawing, a sensitized drum 11 is rotatably supported and driven by a motor (not shown) so as to rotate in a clockwise direction. Around the sensitized drum 11, there are provided a charge device 12, a charge removal device 13, a laser source 14 for exposing image (i.e. exposure device), and a surface voltage measuring sensor 15. This testing apparatus is flexible in that above components 12–15 can be optionally rearranged. This sensitized drum 11 is covered with a positively charged, single-layer type OPC including nonmetallic phthalocyanine as a photosensitive material, whose detail is disclosed in the above Unexamined Japanese Patent Application No. 3-287171/1991. The surface voltage measuring sensor 15 is made of a transparent material, so that a laser beam emitted from the laser source (i.e. exposure device) 14 can pass through it and reach on the surface of the sensitized drum 11.

The OPC testing portion on the sensitized drum 11 is, first of all, uniformly charged by the charge device 12 so as to have positive electric charges thereon. The OPC testing portion is then rotated in the clockwise direction until it reaches a position A where it directly confronts with the surface voltage measuring sensor 15. When the OPC testing portion stops there, the laser beam is irradiated on the OPC testing portion through the surface voltage measuring sensor 15 so as to form a latent image thereon.

In more detail, the charge device 12 charges the surface of the OPC testing portion to have a surface voltage of approximately 700 V. Then, the OPC testing portion is exposed by a monochromatic light having a wave length of 780 nm and a pulse width of 12 msec. The exposure intensity is 160 $\mu W/cm^2$ in this case.

Under these condition, a voltage attenuation speed of the single-layer type OPC is measured by the sensor 15 by variously changing the time difference T1 between charge and exposure devices 12, 14. In this case, a response time $T_{1/5}$ is introduced to define the voltage attenuation. The response time $T_{1/5}$ is equal to an exposure time during which the surface voltage of the OPC testing portion is reduced to a ⅕ value by the irradiation of the exposure device 14. For example, during the response time, the surface voltage is reduced from 700 V to 140 V.

Figure 3:
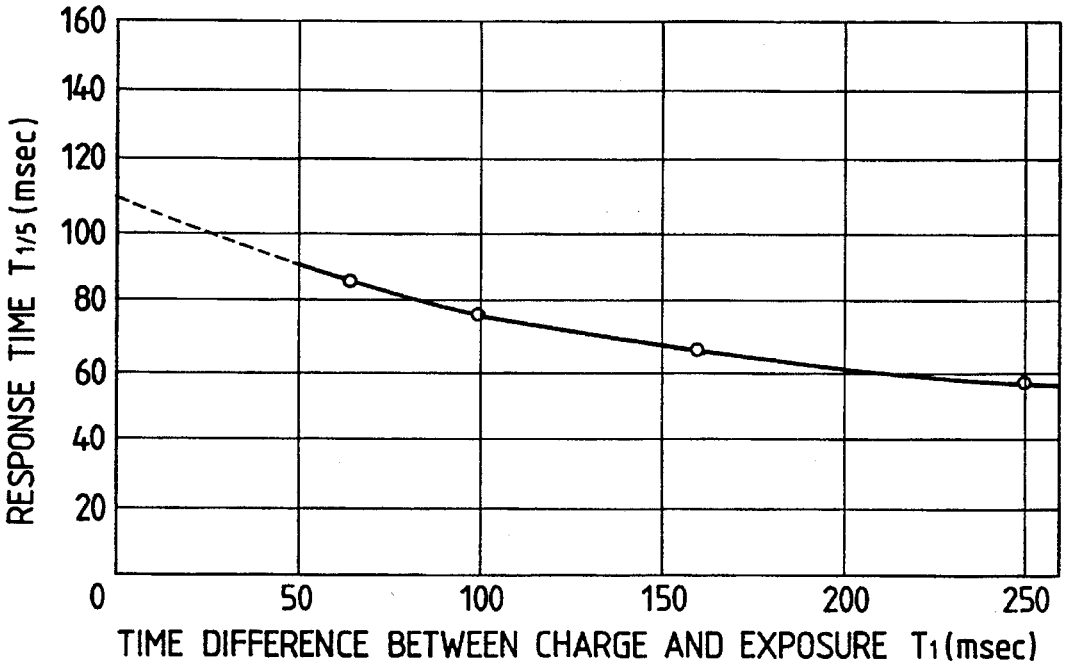
FIG. 3 is a graph showing a relationship between a time difference T1 and a response time $T_{1/5}$ in accordance with the first embodiment.

FIG. 3 shows the testing result, wherein an abscissa represents the time difference T1 and an ordinate represents the response time $T_{1/5}$. As understood from FIG. 3, the single-layer type OPC is characterized in that its response time $T_{1/5}$ becomes slow with reducing time difference T1.

As the time difference between charge and develop devices is defined by T2, T2–T1 is identical with a time difference between exposure and develop devices.

In order to assure satisfactory development, it is noted that the exposure must be carried out satisfactorily. In general, the exposure is carried out by irradiating a light on a uniformly charged OPC. Light irradiation generates an exciton in the photosensitive material. This exciton causes dissociation due to electrostatic field applied. Therefore, an electric charge on the surface is neutralized. In other words, the surface voltage is reduced. Thus, a latent image is finally formed on the OPC surface.

To ensure this latent image forming process, it will be apparent that the surface voltage must be sufficiently reduced during this time difference T2–T1. In other words, it is important that the latent image is surely formed before the sensitized drum reaches the develop unit. The response time $T_{1/5}$ is considered to be a decisive time for causing sufficient surface voltage drop. Therefore, the response time $T_{1/5}$ needs to be equal to or less than the time difference T2–T1 in order to assure satisfactory exposure and succeeding development.

The test data obtained in FIG. 3 is peculiar to the single-layer type OPC, since the conventional double-layer type OPC has a constant response time $T_{1/5}$ irrespective of the time difference T1 between charge and exposure devices.

Thus, in case of the single-layer type OPC, the positional relationship among charge, exposure, and develop devices and an exposure light itself must satisfy the following relationship.

$$T_{1/5} \leqq T2-T1 \quad (1)$$

Namely, $$T2 \geqq T1+T_{1/5} \quad (2)$$

Each value of the time difference T2 is obtained from the test data T1 and T⅕ of FIG. 2.

Figure 4:
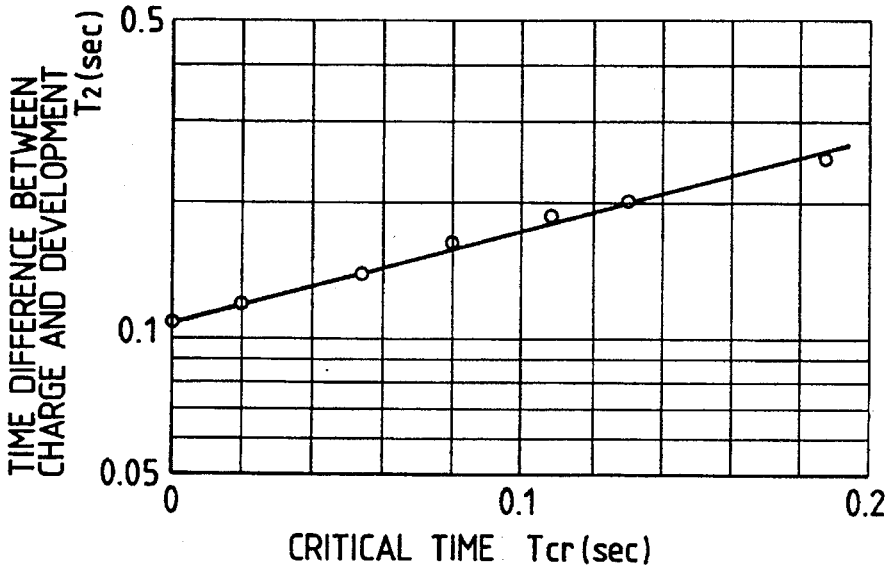
FIG. 4 is a graph showing a relationship between a critical time Tcr and a time difference T2 in accordance with the first embodiment.

Now let us suppose that a critical time Tcr is a minimum time difference T2–T1 required for obtaining a satisfactory surface voltage drop. This critical time Tcr is obtained with respect to each T2. FIG. 4 shows the relationship between thus obtained critical time Tcr and the time difference T2. It will be apparent from FIG. 4 that the time difference T2 varies exponentially with respect to the critical time Tcr.

This exponential relationship is expressed as follows:

$$T2=0.11\times10^{2Tcr} \quad (3)$$

Namely, the critical time Tcr is defined in the following equation.

$$Tcr=0.5 \log T2+0.48 \quad (4)$$

wherein log T2 is expressed by use of a common logarithm.

An actual time difference T2–T1 between exposure and develop devices needs to be larger than the critical time Tcr.

$$T2-T1 \geqq Tcr \quad (5)$$

Therefore, the following relationship is obtained on the basis of equations (4) and (5).

$$T1 \leqq T2-0.5 \log T2-0.48 \quad (6)$$

Wherein T2>0.11 sec.

Next, test result of photosensitivity characteristics will be explained.

Figure 5:
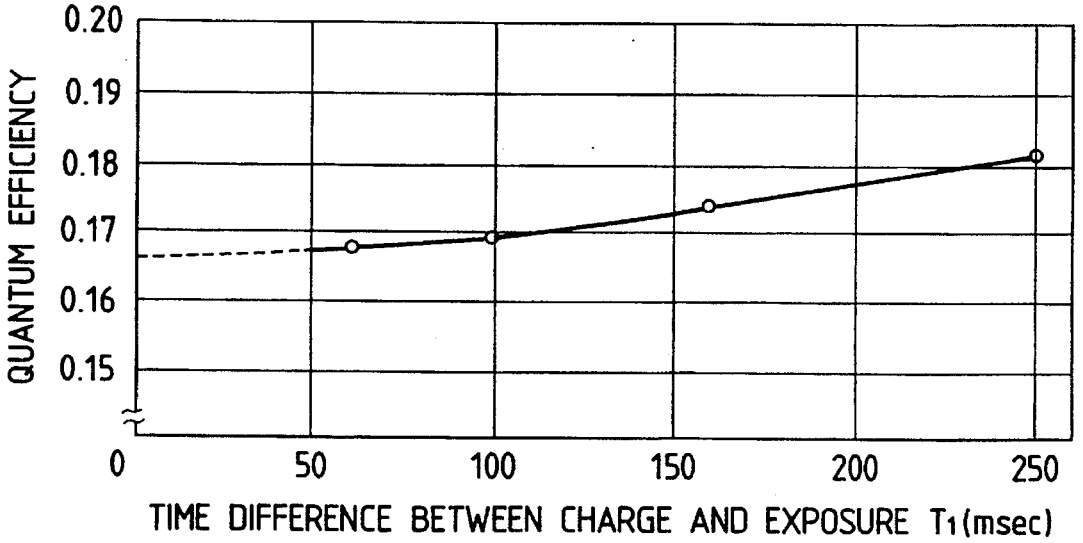
FIG. 5 is a graph showing a relationship between the time difference T1 and a quantum efficiency in accordance with the first embodiment.

A weak light having an exposure energy of 1 $\mu W/cm^2$ is used for 2-second exposure. FIG. 5 shows the test data. In FIG. 5, an abscissa represents the time difference T1 between charge and exposure devices, an ordinate represents quantum efficiency. The quantum efficiency is generally defined by a ratio of exciton number neutralizing electric charge with respect to incident photon number. It will be apparent from FIG. 5 that electric charge generation efficiency increases with increasing time difference T1. Accordingly, it is preferable to extend the time difference T1 as long as possible.

However, an upper limit of the time difference T1 is restricted by the equation (1). Hence, it is preferable to determine the time difference T2–T1 as close to the response time $T_{1/5}$ as possible. This setting will be advantageous in suppressing necessary exposure energy to a lower level.

Figure 6:
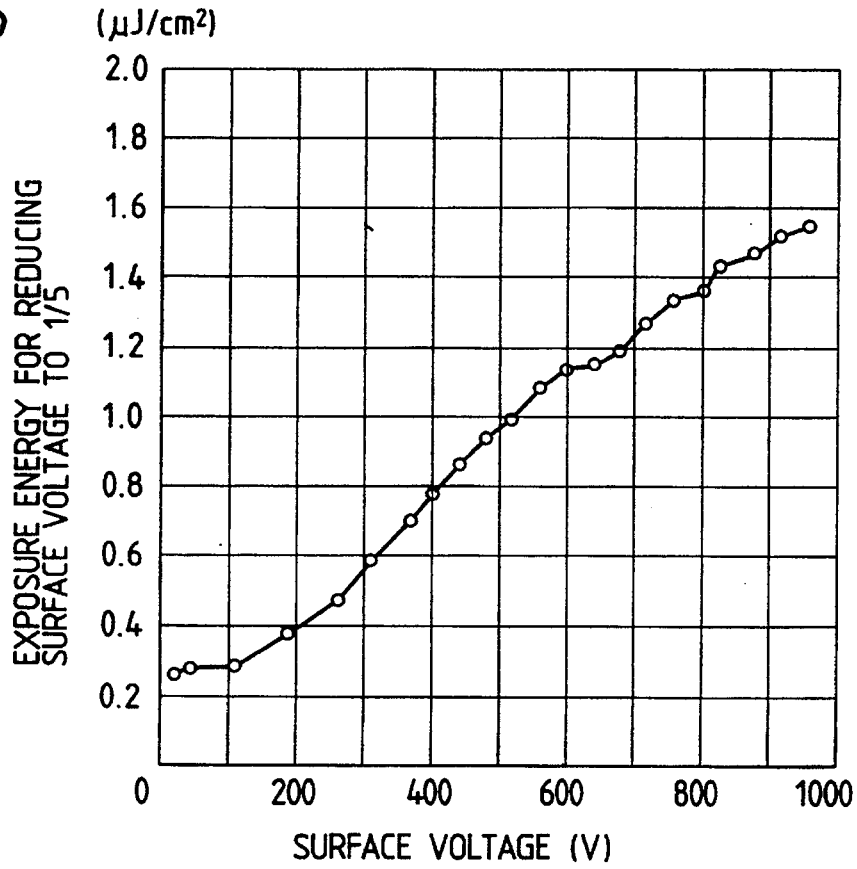
FIG. 6 is a graph showing a relationship between a surface voltage and an exposure energy for reducing the surface voltage to 1/5 in accordance with the first embodiment.

FIG. 6 shows test data measuring photosensitivity under the layout satisfying the equation (6). In FIG. 6, an abscissa represents a charged surface voltage of the single-layer type OPC, and an ordinate represents an exposure energy required for reducing the surface voltage into a ⅕ value.

As the minimum charge voltage required for forming satisfactory contrast of electrostatic charges is generally considered to be approximately 450 V, it is concluded that the required exposure energy is equal to or more than approximately 0.9 $\mu J/cm^2$.

Next, stability of OPC surface voltage will be discussed. Through numerous tests, the inventors of this application found the time difference T3 between the charge removal device and charge device is essential for the stability of the OPC surface voltage.

Returning to the testing apparatus of FIG. 2, the charge removal device 13 is provided at a position B or a position C around the sensitized drum 11. When placed on the position B, the charge removal device 13 is spaced 180 degrees from the charge device 12 in the clockwise direction. When placed on the position C, the charge removal device 13 is spaced 60 degrees from the charge device 12 in the counterclockwise direction. The sensitized drum 11 has a diameter of 30 mm and its rotational speed is 60 rpm. The charge device 12 applies 5.5. kV. The charge removal energy in the charge removal device 13 is set to 2 $\mu J/cm^2$. An exposure light has a wave length of 660 nm.

Figure 7:
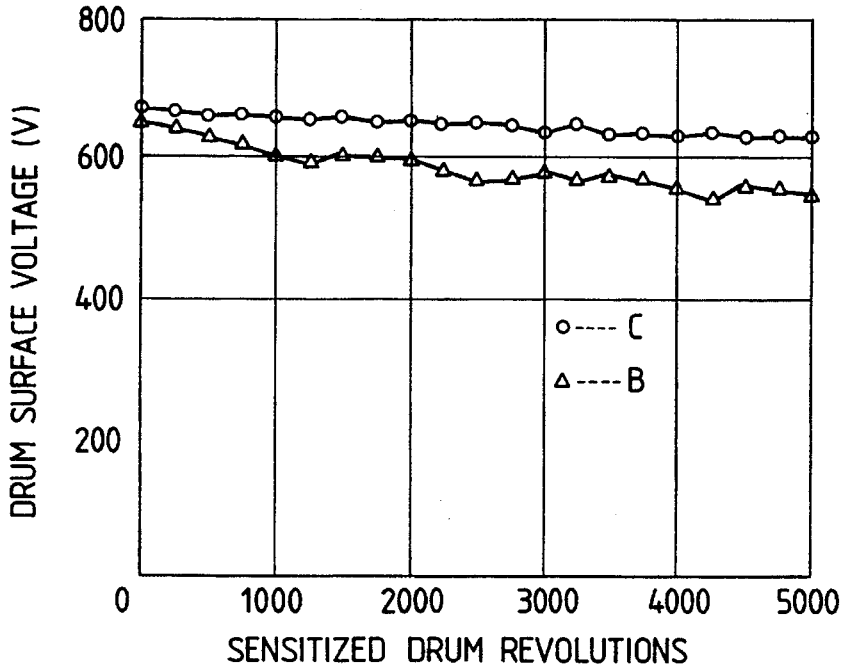
FIG. 7 is a graph showing a relationship between a sensitized drum revolution number and a drum surface voltage in accordance with the first embodiment.

FIG. 7 shows the test result, wherein an abscissa represents a total revolution number of the sensitized drum 11 and an ordinate represents a drum surface voltage. As apparent from FIG. 7, the drum surface voltage is stable in the position C compared with the position B. Thus, it is preferable to set the time difference T3 between the charge removal device and the charge device as short as possible. The inventors concluded that a preferable range of the time difference T3 between the charge removal device and the charge device is equal to or less than 0.2 sec.

Figure 8A:
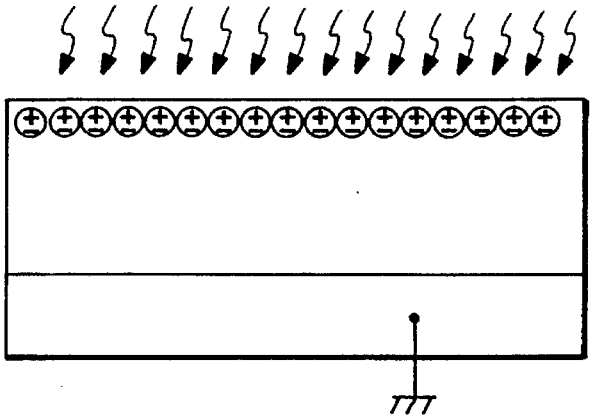
FIGS. 8(A)–8(C) illustrate generation, dissociation, and transfer mechanisms of excitons in accordance with the first embodiment.
Figure 8B:
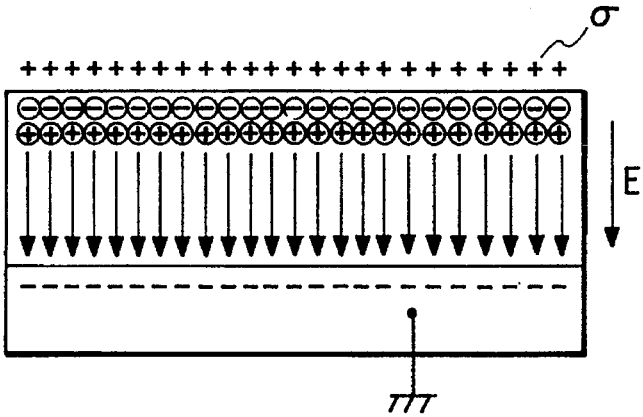
Figure 8C:
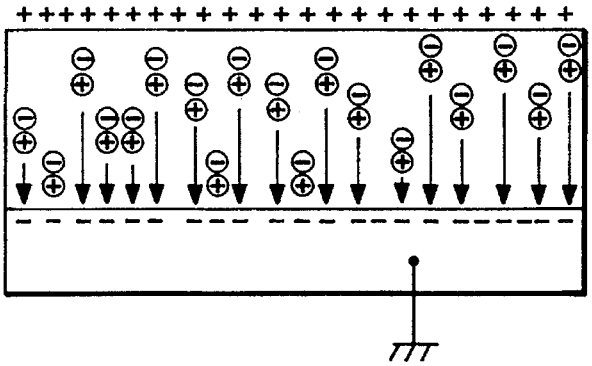

FIGS. 8(A) through 8(C) illustrate mechanism of repetitive surface voltage change. First of all, the charge removal device 13 emits a charge removal light uniformly on all the surface of the single-layer type OPC. Upon this light irradiation, excitons are generated near the upper surface of the single-layer type OPC, as shown in FIG. 8(A). Subsequently, the charge device 12 charges the single-layer type OPC to have an electric charge σ on its upper surface. This electric charge σ forms an electric field E. This electric field E causes each exciton to separate into positive and negative electric charges as shown in FIG. 8(B). The electric charge then initiates moving downward under the affection of the electric field E. In proportion to the transfer amount of these electric charges, neutralization of the surface charge σ progresses.

FIG. 8(B) illustrates a condition where the time difference between the charge removal device 13 and the charge device 12 is small, while FIG. 8(C) illustrates a condition where the time difference between the charge removal device 13 and the charge device 12 is large. As shown in FIG. 8(C), the exciton tends to cause a diffusion as the time elapses.

If the exciton diffuses deeply in the OPC, an electron is trapped there after the exciton causes a dissociation. If such an electron trap increases, the surface charge for maintaining a required surface voltage have to be correspondingly increased.

For the reasons above described, the time difference is preferable to set as small as possible and will be acceptable if it is equal to or less than 0.2 sec from the result of FIG. 7.

Figure 9A:
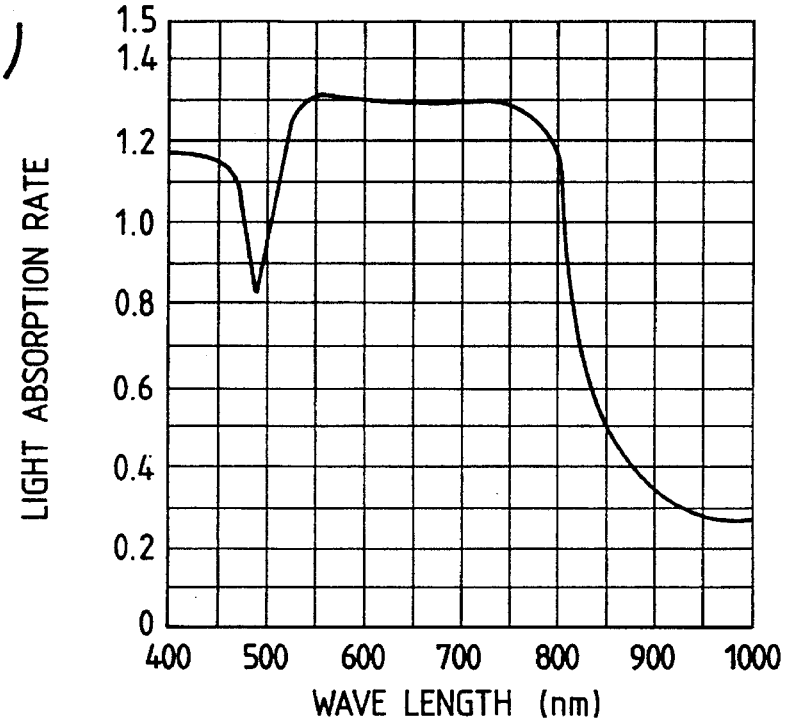
FIG. 9(A) is a graph showing a relationship between an exposure light wavelength and a light absorption rate in accordance with the first embodiment.
Figure 9B:
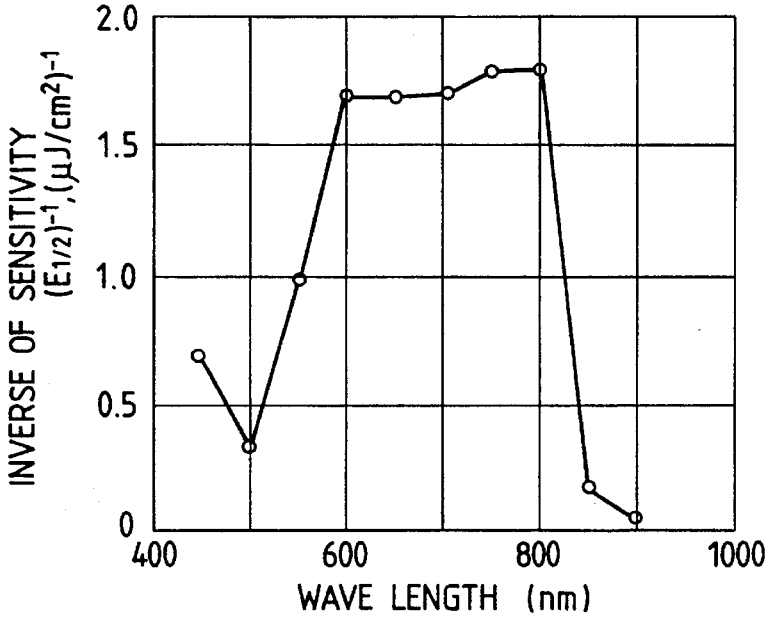
FIG. 9(B) is a graph showing a relationship between the exposure light wavelength and an inverse of sensitivity in accordance with the first embodiment.

The test was further conducted about the wave length of the charge removal light. FIG. 9(A) shows a light absorption curve vs. wave length in a single-layer type OPC. From FIG. 9(A), it is known that the light absorption rate is small in a visible-ray region less than 550 nm and an infrared-ray region more than 800 nm. FIG. 9(B) shows a spectral sensitivity of the single-layer type OPC. This spectral sensitivity curve shows a good agreement with the light absorption rate of FIG. 9(A).

Namely, light energy is effectively converted into an electric energy in the wavelength region having higher photosensitivity. Thus, almost all the light is absorbed near the incident surface of the OPC and, therefore, excitons generate near the surface of the OPC in the same manner as in the case shown in FIG. 8(B). On the other hand, light energy is not effectively converted into an electric energy in the wavelength region having lower photosensitivity. Thus, light enters deeply into the OPC. In this case, excitons are generated inside the OPC. This condition is considered to correspond to the condition shown in FIG. 8(C). As a result, it is concluded that the wavelength of the charge removal light should be set within a range from 550 nm to 800 nm.

Figure 10:
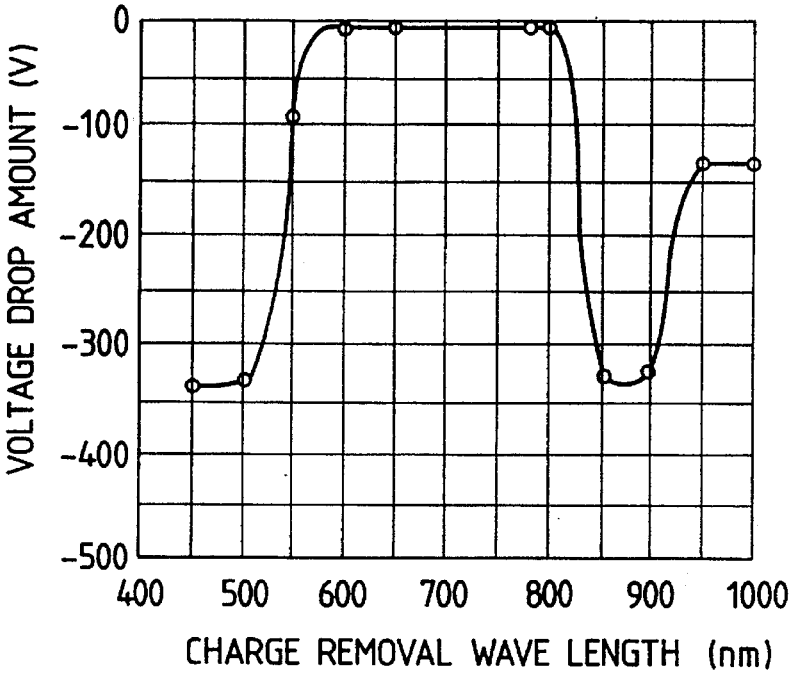
FIG. 10 is a graph showing a relationship between a charge removal light wavelength and a voltage drop amount in accordance with the first embodiment.

In order to prove this, repetitive stability of the surface voltage is examined by varying the wavelength of light removal light. In this test, the OPC is charged up to 700 V and then the charge is removed therefrom. This cycle is repeated 1000 times. FIG. 10 shows the test result, wherein an abscissa represents the wave length of the charge removal wave length and an ordinate represents a voltage drop amount from 700 v after above 1000 cycles. It is apparent from FIG. 10 that the voltage drop does not occur in the wavelength region having a higher light absorption rate and, on the contrary, a significant voltage drop occurs in the wavelength region having a lower light absorption rate. It is considered that this phenomenon is caused because the charge removal light enters deep into OPC in the same manner as in the case of FIG. 8(C).

Accordingly, from above-explained test results, it is concluded that the best result will be obtained by setting the wavelength of the charge removal light within a range of 550 nm through 800 nm as well as setting the time difference between the charge removal device and the charge device to be equal to or less than 0.2 sec.

Figure 11:
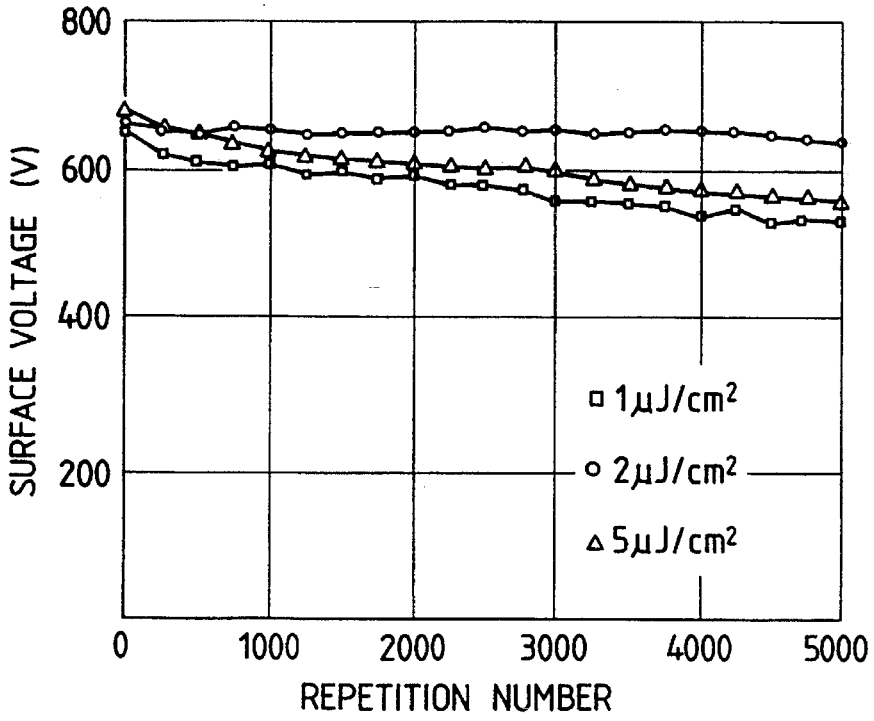
FIG. 11 is a graph showing a relationship between a repetition number and a surface voltage in accordance with the first embodiment.

Next, the affection of charge removal light energy was tested on the testing apparatus with the charge removal device 13 placed on the position C. FIG. 11 shows the test result under the energy condition from 2 to 5 $\mu J/cm^2$. As apparent from FIG. 11, the best result was obtained when the charge removal light energy was 2 $\mu J/cm^2$.

Furthermore, the test for optimizing the relationship between the exposure intensity and the exposure time was conducted. The following Table 1 shows the test result.

TABLE 1

| EXPOSURE | EXPOSURE INTENSITY ($mW/cm^2$) | | | | | |
|---|---|---|---|---|---|---|
| TIME | 0.005 | 0.01 | 0.1 | 0.3 | 1.0 | 3.0 |
| 30 msec | — | NG | NG | — | NG | NG |
| 10 msec | NG | OK | — | OK | OK | OK |
| 1 msec | — | OK | — | OK | — | OK |
| 0.3 msec | NG | — | OK | OK | — | — |
| 0.1 msec | — | OK | — | — | OK | — |
| 0.05 msec | — | NG | — | OK | — | OK |

Some results in the lower left of Table 1 were evaluated to be no good because of worse residual voltage. Furthermore, all the results of exposure time 30 msec were evaluated to be no good because of unstable charge voltage. It is concluded, therefore, from the result of Table 1 that a preferable result can be obtained by the combination of the exposure intensity equal to or larger than 10 $\mu W/cm^2$ and the exposure time equal to or less than 10 msec.

To further clearly identify the optimum region, the relationship between the exposure time and a response time $T_{1/2}$ was tested. The response time $T_{1/2}$ is equal to an exposure time during which the surface voltage of the OPC testing portion is reduced to a half value by the irradiation of the exposure device. For example, during the response time $T_{1/2}$, the surface voltage is reduced, for example, from 800 V to 400 V.

The following Table 2 shows the test result.

TABLE 2

| EXPOSURE | EXPOSURE INTENSITY ($mW/cm^2$) | | | | | |
|---|---|---|---|---|---|---|
| TIME | 0.005 | 0.01 | 0.1 | 0.3 | 1.0 | 3.0 |
| 30 msec | — | NG | NG | — | NG | NG |
| 10 msec | NG | OK | — | OK | OK | *NG |
| 1 msec | — | *NG | — | OK | — | OK |
| 0.3 msec | NG | — | *NG | OK | — | — |
| 0.1 msee | — | *NG | — | — | OK | — |
| 0.05 msec | — | NG | — | *NG | — | OK |

The data suffixed by * are newly evaluated to be no good in this test. All the NG data in the lower left of Table 2 were characterized in that each specified exposure time Tn accounted for more than 65% of its overall response time $T_{1/2}$.

The specified exposure time is defined as follows. When the exposure intensity is specified at a certain constant value, the response time $T_{1/2}$ remains at the same value for a while even if the exposure time is reduced. However, if the exposure time is further reduced, the response time $T_{1/2}$ sharply increases. The specified exposure time Tn is an exposure time immediately before the response time $T_{1/2}$ initiates increasing. In other words, the specified exposure time Tn is a minimum exposure time required for the exposure device to obtain a constant response, i.e. half-value, time $T_{1/2}$.

Figure 16:
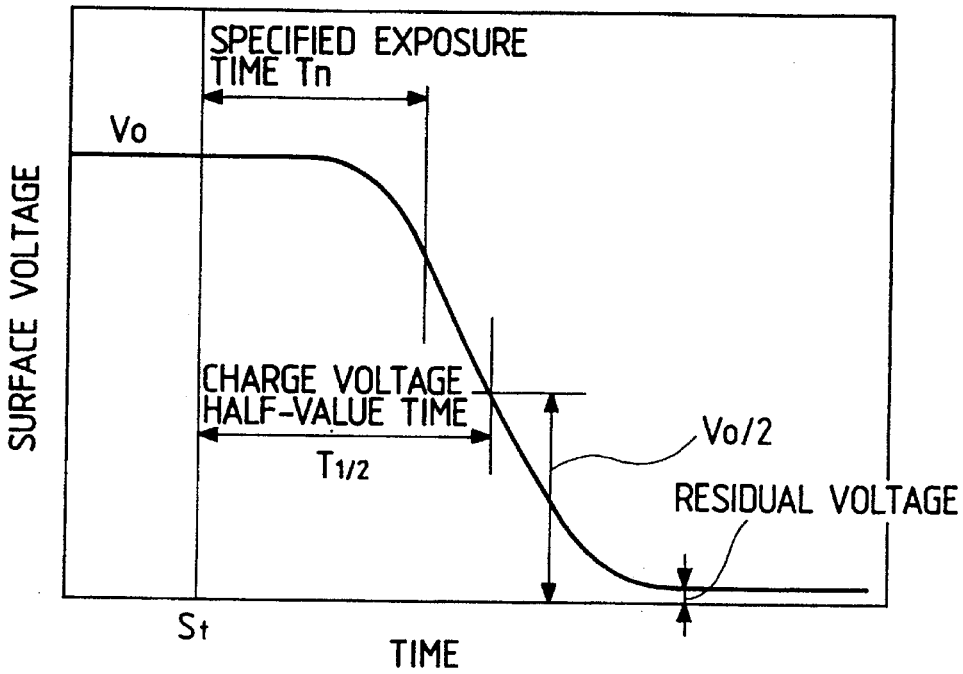
FIG. 16 is a graph showing a relationship between a response time $T_{1/2}$ and a specified exposure time Tn in accordance with the first embodiment.

FIG. 16 shows the relationship between the response time $T_{1/2}$ and the specified exposure time Tn.

Accordingly, it is concluded that the more better result will be obtained if the specified exposure time Tn accounts for 65% or less of the response time $T_{1/2}$.

The following Table 3 shows the test result conducted the same test on a different OPC sample.

TABLE 3

| EXPOSURE | EXPOSURE INTENSITY (mW/cm²) | | | | | |
|---|---|---|---|---|---|---|
| TIME | 0.005 | 0.01 | 0.1 | 0.3 | 1.0 | 3.0 |
| 30 msec | — | NG | NG | — | NG | NG |
| 10 msec | NG | #NG | — | OK | OK | OK |
| 1 msec | — | *NG | — | OK | — | OK |
| 0.3 msec | NG | — | *NG | #NG | — | — |
| 0.1 msec | — | *NG | — | — | OK | — |
| 0.05 msec | — | NG | — | *NG | — | OK |

Although the data suffixed by # is different from Table 2, all the NG data in the lower left of Table 3 were characterized in that each specified exposure time Tn accounted for more than 65% of its overall response time $T_{1/2}$ in the same manner as the previous example.

Next, the exposure intensity was extensively tested. The following Table 4 shows the test result.

TABLE 4

| EXPOSURE | EXPOSURE INTENSITY (mW/cm²) | | | | |
|---|---|---|---|---|---|
| TIME | 0.1 | 3.0 | 10 | 1000 | 30000 |
| 10 msec | OK | OK | NG | — | — |
| 1 msec | OK | — | OK | — | — |
| 100 μsec | NG | OK | — | NG | — |
| 30 μsec | NG | OK | — | OK | — |
| 10 μsec | — | NG | OK | — | — |
| 3 μsec | — | — | NG | — | NG |
| 1 μsec | — | — | — | — | OK |
| 100 nsec | — | — | — | OK | — |
| 10 nsec | — | — | — | NG | OK |

From the result of Table 4, it is concluded that the desirable result will be obtained by setting the value of a product of the light intensity of the exposure device and the specified exposure time Tn within a range of $3\times10^{-5}$ through $1\times10^{-7}$.

SECOND EMBODIMENT

Figure 12:
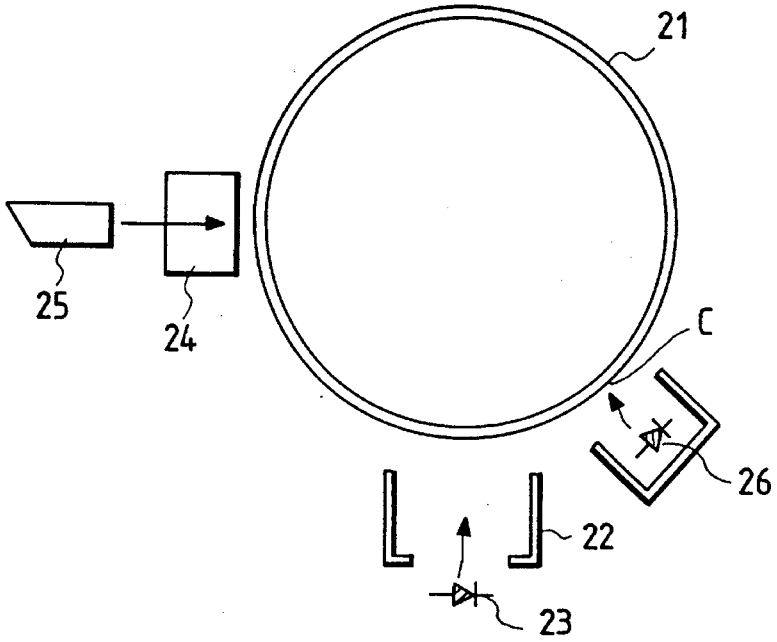
FIG. 12 is a view schematically showing another testing apparatus used in accordance with the second embodiment of the present invention.

FIG. 12 shows another testing apparatus. In the drawing, a sensitized drum 21 is rotatably supported and driven by a motor (not shown) so as to rotate in a clockwise direction. Around the sensitized drum 21, there are provided a charge device 22, a surface voltage measuring sensor 24, a laser source 25 for exposing image (i.e. exposure device), and a charge removal device 26. The surface voltage measuring sensor 24 and the laser source 25 are spaced 90 degrees in the clockwise direction from the charge device 22. The charge removal device 26 is placed on the optimized position C; namely the charge removal device 26 is spaced 60 degrees in the counterclockwise direction from the charge device 22. Furthermore, there is provided an LED array 23 behind the charge device 22. This LED array 23 serves to expose all the surface of the OPC. This array 23 is provided to increase the electric charge generation efficiency by providing together with the charge device 22. The charge device 22 charges the sensitized drum 21 by applying a constant voltage 5.6 kV. The same single-layer type OPC as the previous embodiment is used in this embodiment.

Figure 13:
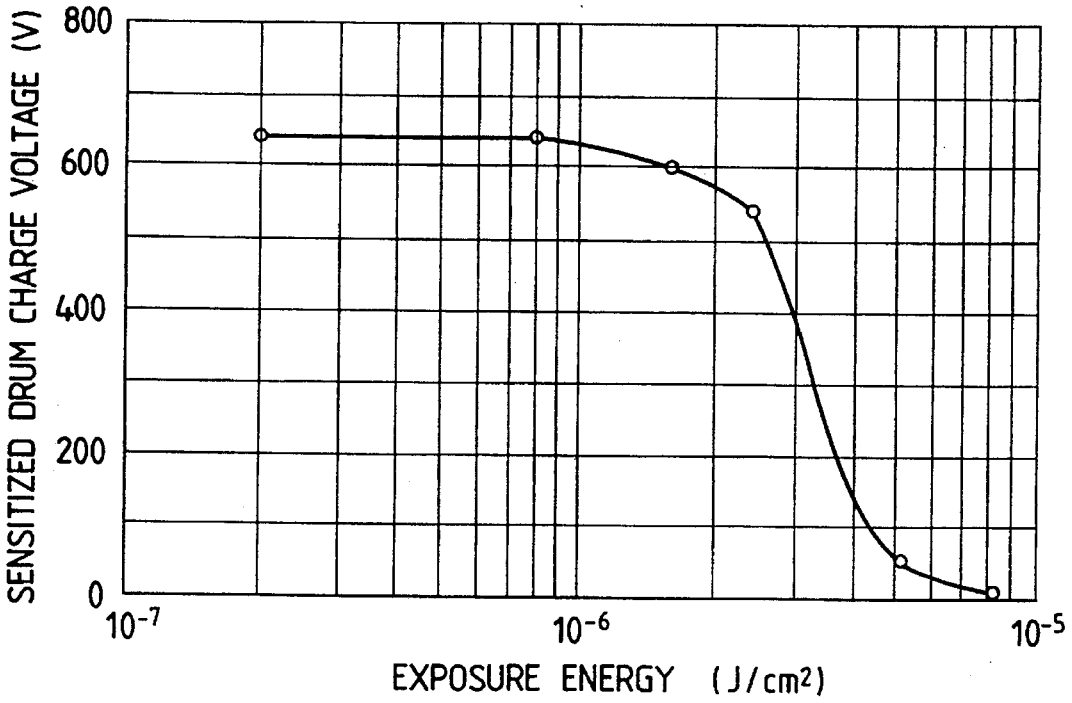
FIG. 13 is a graph showing a relationship between an exposure energy of an LED array and a sensitized drum charge voltage in accordance with the second embodiment.

FIG. 13 is the test data showing a relationship between the exposure energy of the LED array 23 and the charge voltage of the sensitized drum 22.

With reference to FIG. 13, the sensitized drum charge voltage is substantially the same value (i.e. approximately 650 V) when the exposure energy is less than approximately 2 μJ/cm². However, the sensitized drum charge voltage suddenly reduces 30% in the range from 2 to 2.8 μJ/cm². Accordingly it is concluded that no good result is obtained in a certain higher exposure energy region.

Figure 14:
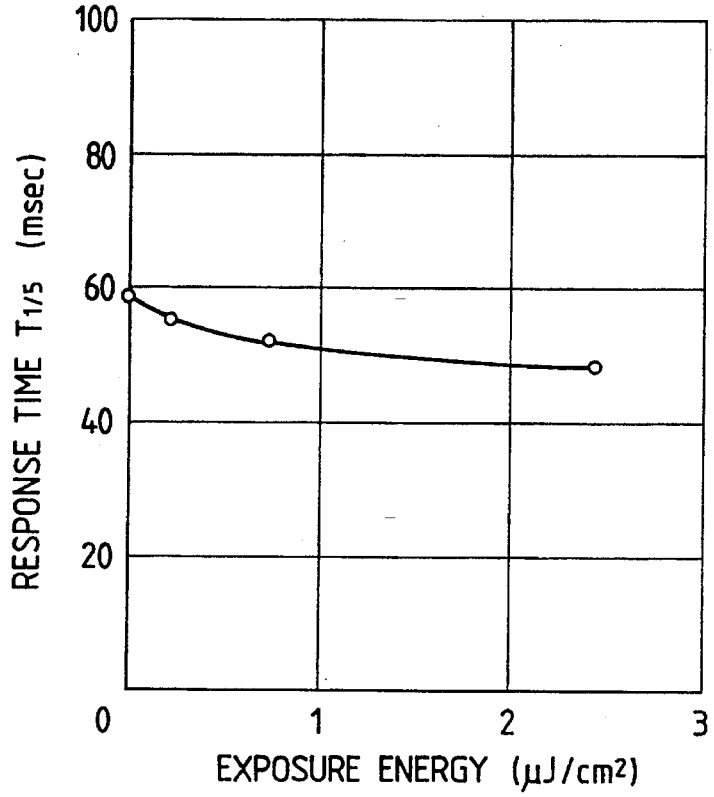
FIG. 14 is a graph showing a relationship between the exposure energy of the LED array and a response time $T_{1/5}$.

FIG. 14 is the test data showing the response time $T_{1/5}$ vs. the exposure energy of the LED array 23. In this test, exposure light was 160 μW/cm² and was irradiated during 12 msec. The light energy of the charge removal device 26 was 2 μJ/cm². The response time $T_{1/5}$ was almost the same irrespective of presence or absence of the LED array 23 or magnitude of the exposure energy.

Figure 15:
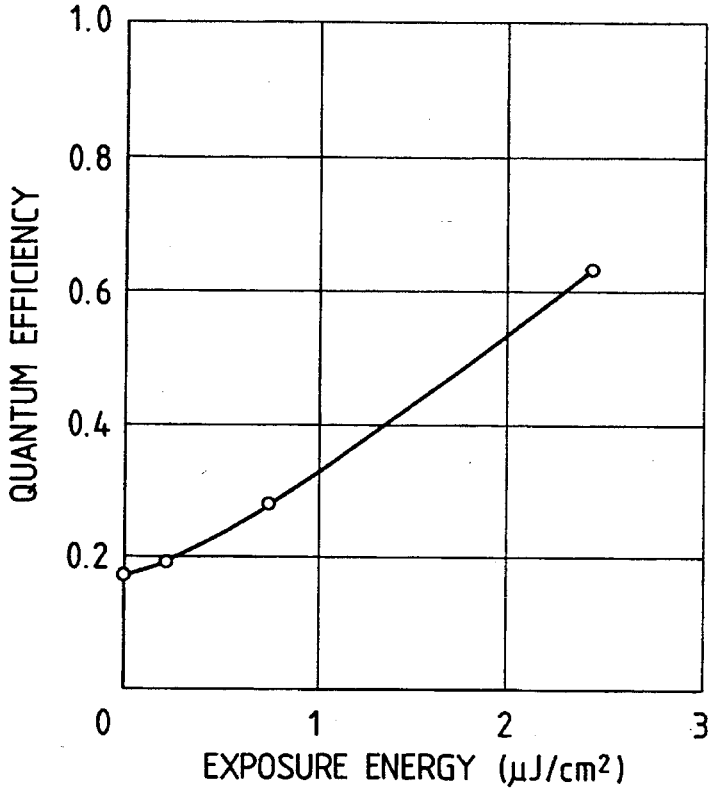
FIG. 15 is a graph showing a relationship between the exposure energy of the LED array and a quantum efficiency.

However, in the case where a very weak exposure light of, for example, 1 μW/cm² is irradiated during 2 sec, the sensitive characteristics has caused a great change. FIG. 15 is the test data showing a relationship between the quantum efficiency vs. the exposure energy. As understood from FIG. 15, the electric charge generation efficiency increases as the exposure energy increases due to the presence of the LED array 23.

Although increasing the exposure energy is, of course, desirable in view of electric charge generation efficiency, the exposure energy should be suppressed not exceed 2 μJ/cm² by taking account of the charged voltage stability.

Considering the results of FIGS. 14 and 15, it is concluded that the exposure energy of the LED array 23 should be suppressed equal to or less than 2 μJ/cm².

THIRD EMBODIMENT

Third embodiment of the present invention will be explained with reference to FIGS. 17–19. This embodiment is characterized in that the gradation characteristics is optimized. It is generally important to adequately control the voltage attenuation of the OPC to assure reproducibility. A quality improvement in an optical printer is earnestly needed. Therefore, an electrophotographic apparatus having excellent gradation characteristics would be desirable. To realize this, the inventors have conducted the following research. In this third embodiment, a single, organic, photosensitive layer of nonmetallic phthalocyanine, which is positively charged, is used as well as the previous embodiments. And a semiconductor laser or a high-density LED coupling element, whose wavelength is in a range of 500 to 800 nm, is used for an exposure device.

Figure 17:
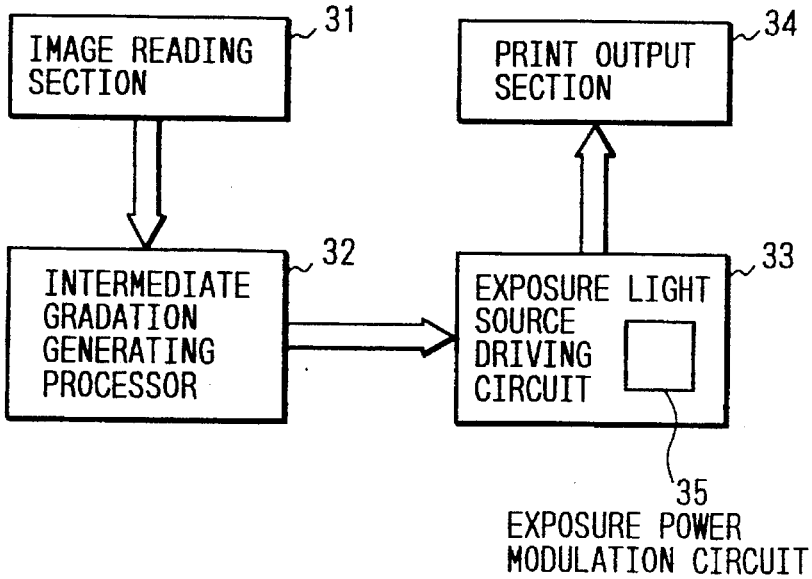
FIG. 17 shows an electrostatic image forming apparatus in accordance with the third embodiment of the present invention.

FIG. 17 shows an electrostatic image forming apparatus in accordance with the third embodiment. An image reading section 31 reads an image and converts it into a binary-coded signal. This encoded signal is supplied to an intermediate gradation generating processor 32 which generates intermediate gradations on the basis of the input signal. An output data of the intermediate gradation generating processor 32 is transferred into an exposure light source driving circuit 33. This exposure light source driving circuit 33 includes an exposure power modulation circuit 35 which modulates an electric current to be supplied to an exposure light.

The exposure power modulation circuit 35 can set a minimum exposure intensity Imin of a spot exposure, a maximum exposure intensity Imax of a spot exposure, and a dividing number N for gradation, as initial values. The minimum exposure intensity Imin corresponds to the minimum image density, and the maximum exposure intensity Imax corresponds to the maximum image density. The exposure light, having thus power modulated, is used to expose the single-layer OPC installed in a print output section 34.

In a test, an optimum combination of the spot exposure conditions Imax and Imin is researched with respect to 8-grade division number. The test result is shown in the following Table 5.

TABLE 5

| | | I max | | | |
|---|---|---|---|---|---|
| | | 0.10 mW | 0.30 mW | 0.60 mW | 1.00 mW |
| I min | 0.05 mW | A | A | BETTER | B |
| | 0.10 mW | — | A | BETTER | B |
| | 0.20 mW | — | A | BEST | B |
| | 0.30 mW | — | — | B | B |
| | 0.50 mW | — | — | B | B |

In Table 5, a letter A represents that the gradation was poor and image density was insufficient. Another letter B represents that the gradation was poor and the image density was not satisfactory in reproducibility of a highlight portion. From the result of Table 5, a multistage exposure light modulation will be preferably carried out by the use of the minimum exposure intensity of 0.05 mW and the maximum exposure intensity Imax of 0.60 mW. The best result will be obtained by using the minimum exposure intensity of 0.2 mW and the maximum exposure intensity Imax of 0.60 mW.

It is found that the desirable range of the exposure intensity is slightly changed depending on a product of sensitized drum speed and optical scanning width in a printer. For example, the minimum exposure intensity of 2 mW is preferable for a copy machine applicable up to A3-sized paper and capable of printing A4-sized papers at a speed of 70 pieces per minute. And, the minimum exposure intensity of 0.1 mW is the lower limit applicable to a low-speed printer.

circuit 43 includes an exposure time modulation circuit 45 which modulates a turning-on time of an exposure light.

The exposure time modulation circuit 45 can vary a pulse width of a spot exposure laser in 8 grades from $70\times10^{-9}$ to $140\times10^{-9}$ sec under 0.5 mW. The exposure light, having thus time modulated, is used to expose a single-layer OPC installed in a print output section 44.

In a test, a diameter of an independent dot is measured together with a maximum density thereof. The following Table 6 shows the test result.

TABLE 6

| MOD. TIME | 70 ns | 80 ns | 90 ns | 100 ns | 110 ns | 120 ns | 130 ns |
|---|---|---|---|---|---|---|---|
| DIA-METER | 38μ | 49μ | 63μ | 71μ | 78μ | 88μ | 86μ |
| DENSITY | 0.33 | 0.54 | 0.84 | 1.07 | 1.23 | 1.37 | 1.38 |

As apparent from Table 6, both the diameter and density show appropriate, moderate gradation in accordance with the moderation time.

In a practical use, the pulse width of a spot exposure laser will be shortened down to a level of $10\times10^{-9}$ sec. As a result of further research, it was found that a laser exposure intensity of 4 mW was necessary corresponding to this presumed lowest exposure time.

Figure 19:
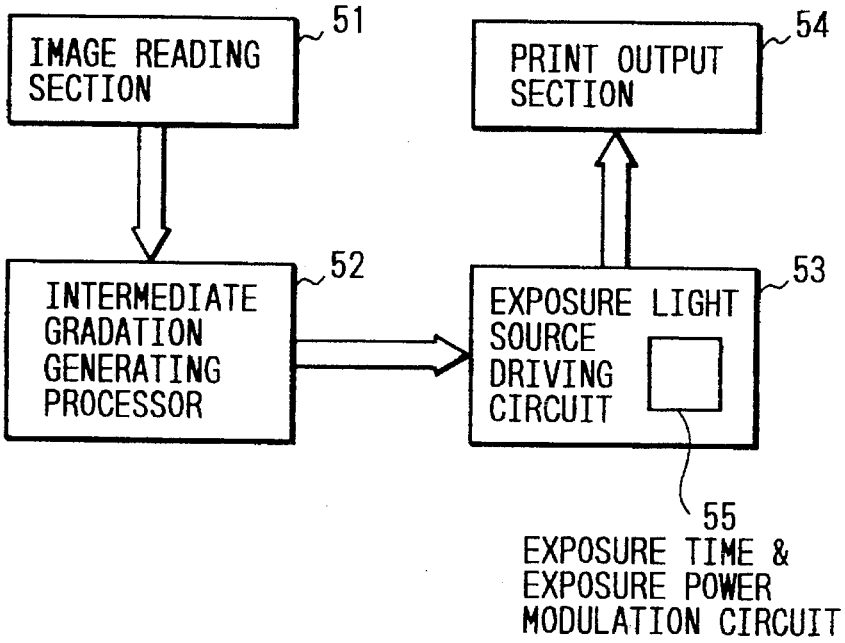
FIG. 19 shows still another electrostatic image forming apparatus in accordance with the third embodiment of the present invention.

FIG. 19 shows still another electrostatic image forming apparatus in accordance with the third embodiment. An image reading section 51 reads an image and converts it into a binary-coded signal. This encoded signal is supplied to the intermediate gradation generating processor 52 which generates intermediate gradations on the basis of the input signal. An output data of the intermediate gradation generating processor 52 is transferred into an exposure light source driving circuit 53. This exposure light source driving circuit 53 includes an exposure time & exposure power modulation circuit 55 which simultaneously modulates an electric current and a turning-on time of an exposure light.

Assuming that the spot exposure intensity is I mW on the OPC and the laser pulse width is T sec, a test was conducted by varying a value of a product of I×T, i.e. a laser exposure energy E, in 8 grades from 0 to $100\times10^{-12}$ J/1 dot. The following Table 7 shows the relationship between each level of the exposure energy E vs. a surface voltage of the OPC. In this case, the lowest level (1) corresponds to 0 J/1 dot and the highest level (8) corresponds to $100\times10^{-12}$ J/1 dot. The levels (2) through (7) are intermediated levels between $0–100\times10^{12}$ J/1 dot.

TABLE 7

| EXPOSURE AMOUNT | LEVEL (1) | LEVEL (2) | LEVEL (3) | LEVEL (4) | LEVEL (5) | LEVEL (6) | LEVEL (7) | LEVEL (8) |
|---|---|---|---|---|---|---|---|---|
| VOLTAGE | 700 | 700 | 680 | 430 | 180 | 70 | 20 | 20 |

Figure 18:
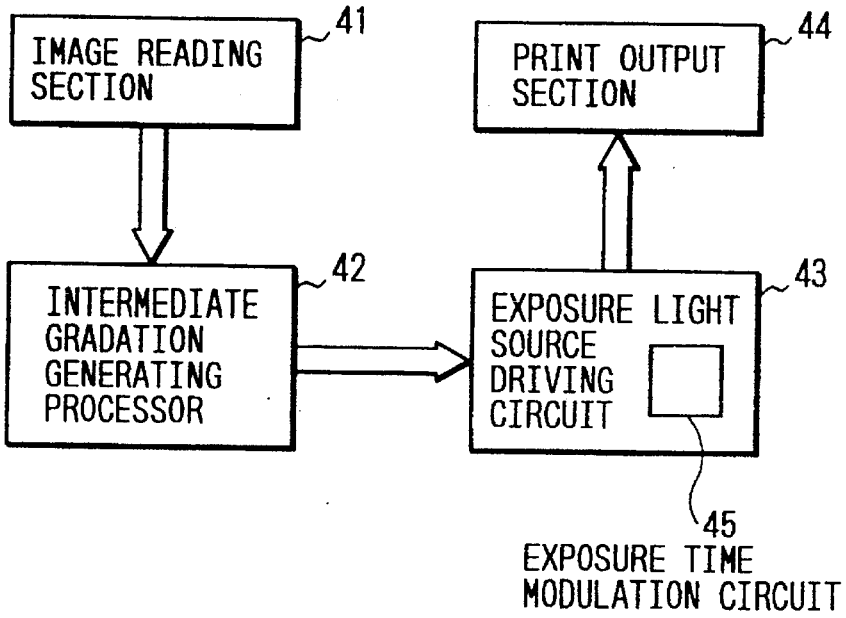
FIG. 18 shows another electrostatic image forming apparatus in accordance with the third embodiment of the present invention.

FIG. 18 shows another electrostatic image forming apparatus in accordance with the third embodiment. An image reading section 41 reads an image and converts it into a binary-coded signal. This encoded signal is supplied to the intermediate gradation generating processor 42 which generates intermediate gradations on the basis of the input signal. An output data of the intermediate gradation generating processor 42 is transferred into an exposure light source driving circuit 43. This exposure light source driving It is understood from Table 7, the levels (3) to (6) show preferable voltage response. This response corresponds to an exposure energy $E_{1/10}$ required to reduce the surface voltage to 1/10 value.

Therefore, the light intensity I is obtained as follows:

$$I=E_{1/10}/T \quad (7)$$

Accordingly, the minimum light intensity Imin can be optimized in the following equation.

$$Imin=E_{1/10}/(T\times N) \quad (8)$$

wherein, N is a dividing number for gradation.

In the same way, the exposure time T is obtained as follows:

$$T=E_{1/10}/I \quad (9)$$

Therefore, the minimum exposure time Tmin can be optimized in the following equation.

$$Tmin=E_{1/10}/(I\times N) \quad (10)$$

As this invention may be embodied in several forms without departing from the spirit of essential characteristics thereof, the present embodiments are therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. An electrostatic image forming apparatus comprising:

a sensitized drum covered with a single, organic, photosensitive layer, said sensitized drum being rotatable in a drum rotation direction at a predetermined speed;

charge means, disposed around said sensitized drum at a charging position, for uniformly charging a surface of said photosensitive layer of said sensitized drum;

latent image forming means, disposed downstream of said charge means in said drum rotation direction around said sensitized drum, for forming a latent image on said photosensitive layer; and developed image forming means, disposed downstream of said latent image forming means in said drum rotation direction around said sensitized drum, for forming a developed image from said latent image;

wherein a distance from said charge means to said latent image forming means is defined with respect to a distance from said charge means to said developed image forming means by the following expression, $$T1\leqq T2-0.5\ log\ T2-0.48$$

wherein T1 is a time required for said sensitized drum to rotate from said charge means to said latent image forming means, and T2 is a time required for said sensitized drum to rotate from said charge means to said developed image forming means.

2. An electrostatic image forming apparatus in accordance with claim 1, wherein said latent image forming means includes an exposure means for exposing said photosensitive layer, whose exposure energy density is equal to or more than 0.9 $\mu J/cm^2$.

3. An electrostatic image forming apparatus in accordance with claim 1, wherein said photosensitive layer contains nonmetallic phthalocyanine and is positively charged.

4. An electrostatic image forming apparatus in accordance with claim 1, wherein said photosensitive layer contains nonmetallic phthalocyanine and is positively charged.

5. An electrostatic image forming apparatus comprising:

a sensitized drum covered with a single, organic, photosensitive layer, said sensitized drum being rotatable in a drum rotation direction at a predetermined speed;

charge means, disposed around said sensitized drum at a charging position, for uniformly charging a surface of said photosensitive layer of said sensitized drum;

latent image forming means, disposed downstream of said charge means in said drum rotation direction around said sensitized drum, for forming a latent image on said photosensitive layer; and developed image forming means, disposed downstream of said latent image forming means in said drum rotation direction around said sensitized drum, for forming a developed image from said latent image;

wherein a distance from said charge means to said developed image forming means is defined by the following expression, $$T2\geqq 0.11\ sec$$

wherein T2 is a time required for said sensitized drum to rotate from said charge means to said developed image forming means.

6. An electrostatic image forming apparatus in accordance with claim 5, wherein said latent image forming means includes an exposure means for exposing said photosensitive layer, whose exposure energy density is equal to or more than 0.9 $\mu J/cm^2$.

7. An electrostatic image forming apparatus in accordance with claim 5, wherein said photosensitive layer contains nonmetallic phthalocyanine and is positively charged.

8. An electrostatic image forming apparatus comprising:

a sensitized drum covered with a single, organic, photosensitive layer, said sensitized drum being rotatable in a drum rotation direction at a predetermined speed;

charge means, disposed around said sensitized drum at a charging position, for uniformly charging a surface of said photosensitive layer of said sensitized drum;

latent image forming means, disposed downstream of said charge means in said drum rotation direction around said sensitized drum, for forming a latent image on said photosensitive layer; and electric charge removal means, disposed downstream of said charge means in said drum rotation direction around said sensitized drum, for removing electric charge from said surface of said photosensitive layer by irradiating light so as to erase said latent image;

wherein a distance from said electric charge removal means to said charge means is defined by the following expression, $$T3\leqq 0.2\ sec$$

wherein T3 is a time required for said sensitized drum to rotate from said electric charge removal means to said charge means.

9. An electrostatic image forming apparatus in accordance with claim 8, wherein said electric charge removal means has an energy density in a range between 2 and 5 $\mu J/cm^2$.

10. An electrostatic image forming apparatus in accordance with claim 8, wherein said photosensitive layer contains nonmetallic phthalocyanine and is positively charged.

11. An electrostatic image forming apparatus comprising:

a sensitized drum covered with a single, organic, photosensitive layer, said sensitized drum being rotatable in a drum rotation direction at a predetermined speed;

charge means, disposed around said sensitized drum at a charging position, for uniformly charging a surface of said photosensitive layer of said sensitized drum;

latent image forming means, disposed downstream of said charge means in said drum rotation direction around said sensitized drum, for forming a latent image on said photosensitive layer; and electric charge removal means, disposed downstream of said charge means in said drum rotation direction around said sensitized drum, for removing electric charge from said surface of said photosensitive layer by irradiating light so as to erase said latent image;

wherein said light of the electric charge removal means has a wave length of 550 nm to 800 nm.

12. An electrostatic image forming apparatus in accordance with claim 11, wherein said electric charge removal means has an energy density in a range between 2 and 5 $\mu J/cm^2$.

13. An electrostatic image forming apparatus comprising:

a sensitized drum covered with a single, organic, photosensitive layer, said sensitized drum being rotatable in a drum rotation direction at a predetermined speed;

charge means, disposed around saidd sensitized drum at a charging position, for uniformly charging a surface of said photosensitive layer of said sensitized drum;

exposure means, disposed downstream of said charge means in said drum rotation direction around said sensitized drum, for forming a latent image on said photosensitive layer; and developed image forming means, disposed downstream of said latent image forming means in said drum rotation direction around said sensitized drum, for forming a developed image from said latent image;

wherein said exposure means has a light intensity equal to or more than 10 $\mu W/cm^2$ and having an exposure time equal to or less than 10 ms.

14. An electrostatic image forming apparatus in accordance with claim 13, wherein said photosensitive layer has a specified exposure time Tn which accounts for 65% or less of a response time $T_{1/2}$, wherein said response time $T_{1/2}$ is defined as a half-value time required for electric charge voltage on the sensitized drum to decrease to a half value, and said specified exposure time Tn is defined as a minimum exposure time required for said exposure means to obtain a constant response time $T_{1/2}$.

15. An electrostatic image forming apparatus in accordance with claim 14, wherein a product of said light intensity of said exposure means and said specified exposure time Tn is within a range of $3\times10^{-5}$ to $1\times10^{-7}$ sec·W/cm$^2$.

16. An electrostatic image forming apparatus in accordance with claim 13, wherein said photosensitive layer contains nonmetallic phthalocyanine and is positively charged.

* * * * *